United States Patent [19]

Bettonica

[11] 4,057,383

[45] Nov. 8, 1977

[54] HYDRAULIC PRESS, PARTICULARLY FOR THE SHAPING AND PRESSING OF CYLINDRIC, OR TRUNCATED-CONE, OR LIKE SHAPED HOLLOW CERAMIC ARTICLES

[76] Inventor: Luigi Bettonica, Via Clusone, 3, Milan, Italy

[21] Appl. No.: 756,283

[22] Filed: Jan. 3, 1977

[30] Foreign Application Priority Data

Jan. 13, 1976 Italy ..... 19183/76

[51] Int. Cl.[2] ..... B30B 5/02; B30B 11/00

[52] U.S. Cl. ..... 425/405 H; 425/412; 425/416; 425/419; 425/422; 425/423

[58] Field of Search ..... 425/78, 406, 408, 411, 425/412, 416, 417, 419, 422, 423, 405 H

[56] References Cited

U.S. PATENT DOCUMENTS

| | | | |
|---|---|---|---|
| 1,759,703 | 5/1930 | Lindenborg | 425/416 |
| 2,338,491 | 1/1944 | Cutler | 425/78 |
| 2,407,123 | 9/1946 | Allison | 425/416 |
| 2,825,092 | 3/1958 | Hatch et al. | 425/78 |
| 3,191,232 | 6/1965 | Haller | 425/78 |
| 3,154,812 | 11/1964 | Haller | 425/78 |
| 3,588,080 | 6/1971 | Wallick | 425/405 H X |
| 3,613,166 | 10/1971 | Wallace et al. | 425/416 X |
| 3,618,179 | 11/1971 | Anderson et al. | 425/417 X |
| 3,659,985 | 5/1972 | Marshall et al. | 425/78 |
| 3,664,799 | 5/1972 | Wallick et al. | 425/405 H X |
| 3,868,201 | 2/1975 | Jacobson et al. | 425/416 X |

*Primary Examiner*—J. Howard Flint, Jr.
*Attorney, Agent, or Firm*—Young & Thompson

[57] ABSTRACT

A hydraulic press for the shaping and pressing of hollow ceramic articles, comprising a bedplate fitted with a horizontal table, on which top a die is fitted, wherein the negative outer shape of the article to be shaped and pressed is reproduced in at least one cavity thereof, being a special pressing member, consisting of a bowl made of an elastically flexible and extensible material, and having at least partly, the negative inner shape of the article to be shaped and pressed, fitted within said cavity, coaxially thereto, and being the possibility given to have said bowl uniformly inflated by introducing a pressure fluid therein; means being also provided to have said die temporarily closed while the ceramic powder or paste, previously introduced therein, is pressed, and to have the duly shaped and pressed ceramic article ejected therefrom.

4 Claims, 4 Drawing Figures

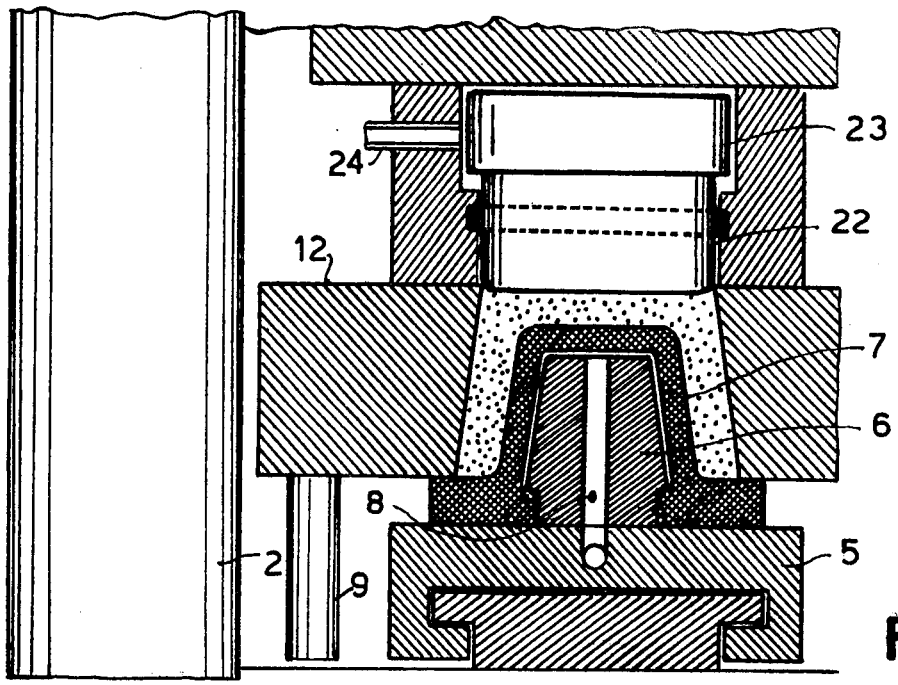
Fig. 3
Fig. 4
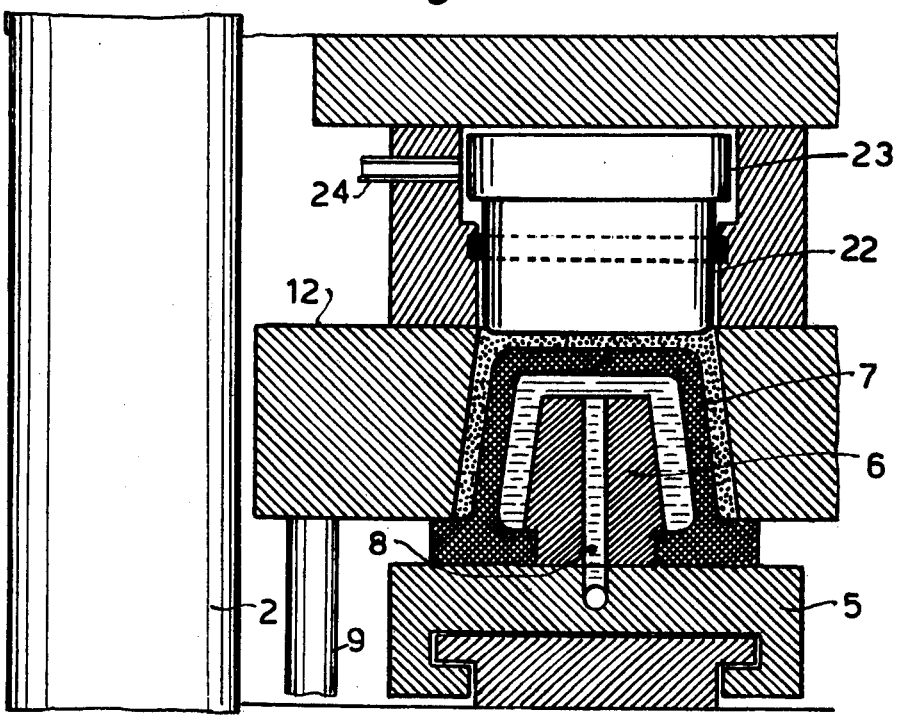

HYDRAULIC PRESS, PARTICULARLY FOR THE SHAPING AND PRESSING OF CYLINDRIC, OR TRUNCATED-CONE, OR LIKE SHAPED HOLLOW CERAMIC ARTICLES

No particular difficulties are to be overcome in designing presses for shaping and pressing the powders, or the mainly claysh and noticeably plastic pastes in the production of flat ceramic articles (e.g. bricks, flat blocks, tiles and the like), or slightly hollowed-out only (e.g. dishes), or even ceramic articles having a given thickness, e.g. greater than 3 millimeters, since it is relatively easy to give to punches (usually of steel) of ram, the negative shape of article to be made, and because when same punches are brought in their, so called "positioning" condition (wherein the die is partly closed by them) they are sufficiently spaced from the die bottom, to allow for an uniform and complete filling of all die cavities with the ceramic material to be pressed.

Conversely, heavy difficulties are encountered in designing presses for the shaping and pressing of powders in the production of hollow, cylindric or truncated-cone shaped ceramic articles or at any rate of articles having deep cavities, above all when it is matter of thin-walled articles, as e.g. coffee cups or the like.

In such cases, the use of dies comprising two press punches only, by which the negative outer shape of the article to be made is reproduced, is not practically possible, whereby recourse is to be made to multiple dies which however, not only are much bulky an expensive but additionally materially reduce the output of machine.

The purpose of this invention consists in the provision of a hydraulic press for the shaping and pressing of ceramic powders and/or pastes, which is particularly suitable for producing hollow, cylindric or truncated-cone shaped, or at any rate deeply hollowed, and even thin-walled ceramic articles.

The hydraulic press according to this invention, essentially comprises:

a. An all-steel machine frame, secured to a suitable bed plate, and by which a horizontal table is supported; sealingly fitted on said table is at least one die, having plan and parallel top and bottom sides, and formed with a cavity by which the negative outer shape of the article to be made is reproduced, being inside of said cavity fitted a special pressing member, consisting mainly of a bowl, made of an elastically flexible and extensible material, and having an outer shape by which the inner shape of article to be made is at least partly reproduced, being said bowl tightly retained on said horizontal table, and being the possibility given to have same bowl uniformly inflated and extended by feeding a pressure fluid thereinto.

b. A "positioning" unit slidingly fitted on column (that are adequately secured to said bed plate) and appropriately controlled by hydraulic means, being said unit utilized for tightly closing the above stated die (after having filled with the powder or the paste the space as defined between the cavity and the pressing member), and before a pressure fluid is fed into the bowl, whereby to obtain the required effect.

For a better understanding of the invention, the hydraulic press will be now described in more detail, reference being made to accompanying drawings, wherein:

FIGS. 3 and 4 are enlarged cross-sections of the unit only, by which the die with the elastically flexible bowl is formed.

In all figures of drawings, all similar, or similarly acting components are marked by the same reference numbers.

Figure 2:
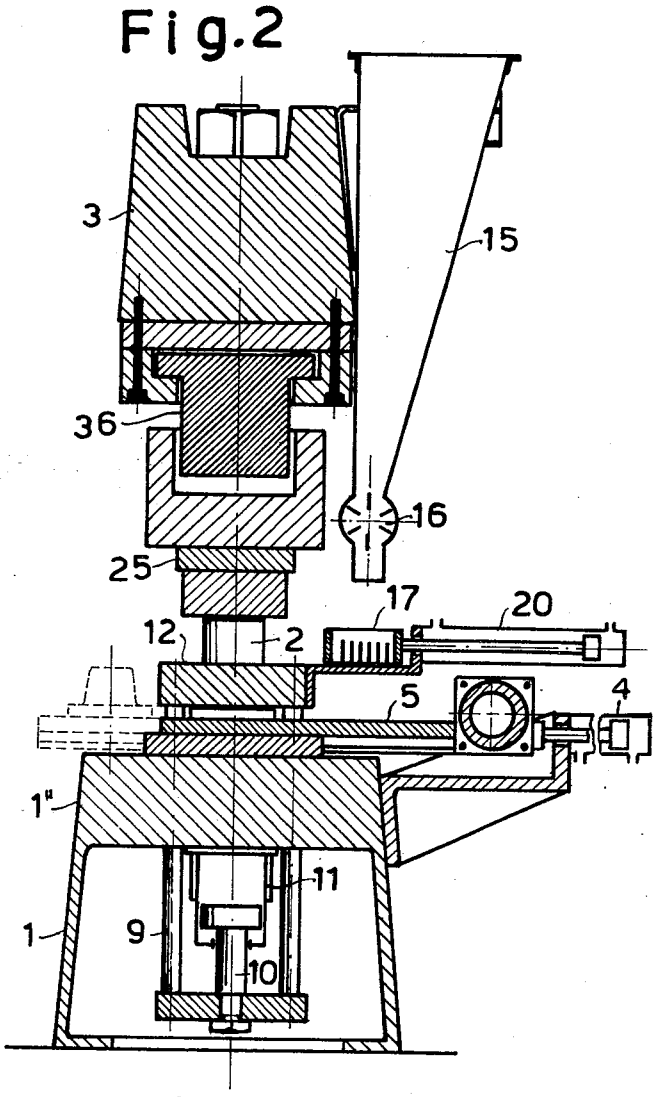
FIG. 2 is a vertical section of same press, taken on the line A—A of FIG. 1.
Figure 1:
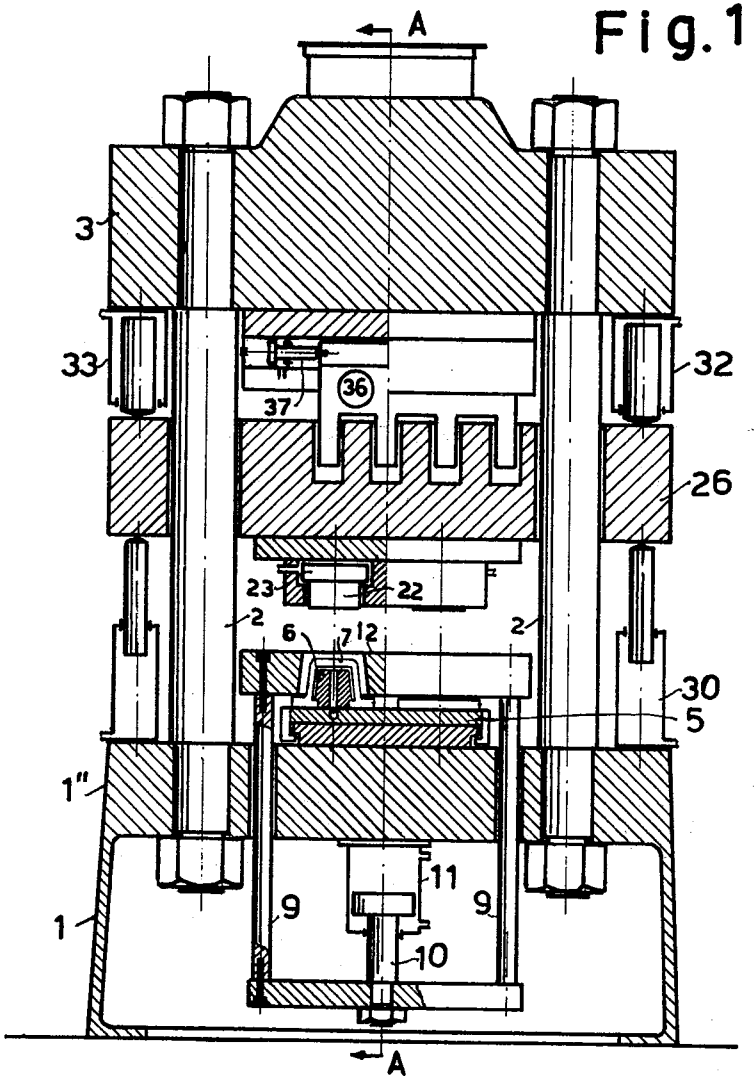
FIG. 1 is a part-sectional front view of a press according to the invention.

Referring now to accompanying drawings, the hydraulic press according to this invention, comprises a bed plate 1, whereon a large horizontal table 1'' is supported at a convenient height from the floor. Rigidly secured to said table are the lower ends of two vertically extending, parallel columns 2, at the upper ends of which a head 3 is fastened, being said head designd to support, along with said upright columns, the positioning unit which will be described in more detail later on. Fast with the table 1'' are guideways, whereon a movable plate 5, driven by a double acting hydraulic jack 4 is slidingly fitted. Supported on said plate 3 is a patrix 6, to which a bowl 7 is secured, and onto which same bowl rests when in its initial, non inflated condition, being same bowl made of an elastically flexible and extensible material (e.g. of synthetic rubber) and being the negative inner shape of article to be made reproduced, at least approximately, by same bowl. Formed in the patrix 6 is a Duct 8, connected with a pump (not shown, and through which a pressure fluid can be fed into the bowl 7. A matrix 12, formed with a cavity having the negative outer shape of the article to be made, is supported by four uprights 9, that are connected with the piston rod 10 or a double acting hydraulic jack 11, being said cavity co-asial with the patrix 6 and with the longitudinal axis of bowl 7.

A hopper 15, fitted with a metering device 16, is supported on one side of machine frame, whereby to fill the box 17 with the powder or parte to be pressed, being said box 17 slidingly fitted on expressly provided guideways, whereby it can be brought, at the required time, by the double acting hydraulic jack 20, above the upper opening of die 12, for filling the space as defined between the recess thereof and the elastic bowl 7.

Above of die 12 is fitted the "positioning unit", duly supported by the head 3 and by the columns 2, and by which the upper opening of die 12 is tightly closed, after same die is filled with the powder or the paste to be pressed. Moreover, the ejector, consisting of at least one rod 22, extending from a piston 23, that can be operated by a pressure fluid, fed through the duct 24, is brought above of die opening, by same positioning unit.

The die closing member and the ejector are secured to plate 25, which is on turn secured to cross member 26, which is slidingly fitted on the columns 2, and thus suitably guided, being same cross member 26 moved downwardly and upwardly by the pairs of hydraulic jacks 30–31 and 32–33.

Stop means are provided to lock the cross member 26, consisting such means of two toothings formed with stub teeth and located in the top of same cross member 26, and in a movable plate 36, respectively. A double acting hydraulic jack 37 is provided for traversing said movable plate 36.

The operation of press according to the invention can be easily understood from the figures of accompanying drawings.

In the initial inoperative position, the different components are in the positions as shown in the figures. I.e. the movable cross member 26 is lifted from the top opening of die 12, the non-inflated bowl 7 rests on the patrix 6 and the box 17 is ready to receive the powder or the paste coming from the hopper 15.

Once the box 17 is filled, it is traversed by the double acting hydraulic jack 20, above of top opening of die 12, whereby the powder or paste to be pressed can be discharged into the space as defined between same die and the elastic bowl 7; then, said box 17 is returned in its initial position by the same hydraulic jack 20.

The movable cross member 26 is lowered by the hydraulic jacks of positioning unit, thereby closing the top opening of die 12. The closing of die is ensured, in the course of pressing step, by the stop means, consisting of rack 36, which when moved by the jack 37, comes in mesh with the teeth as formed in the cross member 26.

Then, a pressure fluid is fed, through the duct 8, between the elastic bowl 7 and the patrix 6, whereby same bown is, so to speak, inflated, i.e. extended and expanded, thus firmly and uniformly pressing the ceramic paste against the patrix, and thereby giving it the required conformation of the article to be made.

The die 12 is then lifted, along the uprights 9, by the piston rod 10 of the double acting hydraulic jack 11, and the ejector 22–23 is simultaneously operated. The formed and pressed articles are thus ejected and are moved outwardly, along with the plate 5, as shown by dotted lines in the FIG. 2.

The feeding of pressure fluid to different ducts that lead to single hydraulic jacks, as well as the adjustment and the interruption of feeding of said fluid at the required time, may be made manually, or preferably by means of electromagnetic valves, acting on the basis of information coming from a suitable programmed control.

Obviously, the press may be of the single, or multi-die type, without departing from the spirit and scope of the invention.

Also obvious is that the hydraulic press, as hereinbefore disclosed, could be efficiently utilized for the forming and pressing of flat, or slightly hollowed ceramic articles, too.

I claim:

1. In a hydraulic press for the shaping and pressing of hollow ceramic articles, the combination of a bed plate fitted with a horizontal table; a double acting hydraulic jack fitted below of said table; a die having planoparallel front sides, and formed with a recess reproducing the negative outer shape of the article to be shaped and pressed; four uprights, slidingly fitted on guides, and by which said die is connected with the piston of said double acting hydraulic jack; a prismatic plate, slidingly fitted on said table, and to which at least one axially bored patrix is secured, being a bowl made of an elastically flexible and extensible material, reproducing the negative inner shape of the article to be made, laid on said patrix; two parallel, vertically directed columns, secured to said bed plate; a cross-member slidingly fitted on said vertical columns, and to which an ejector is secured, consisting said ejector of a cylindric body connected with a piston that can be operated by a pressure fluid, and having a diameter slightly smaller than that of top orifice of die recess, being same ejector fitted co-axially to said recess; two pairs of hydraulic jacks, by which said cross-member, bearing said ejector, is moved upwardly and downwardly, respectively; stop means for firmly retaining said cross member at the required height, whereby to keep closed the top of die recess while the article is being pressed; a hydraulic pump for feeding a pressure fluid throhgh the axial duct of patrix, wherein the elastically flexible and extensible bowl is laid, and a further hydraulic pump, for feeding the pressure fluid to hydraulic jacks by which the cross member, bearing the ejector, is controlled.

2. A hydraulic press for the shaping and pressing of hollow ceramic articles according to claim 1, wherein the elastically flexible and extensible bowl, by which the negative shape of article to be shaped and pressed, is formed with a radially projecting square shoulder.

3. A hydraulic press for the shaping and pressing of hollow ceramic articles according to claim 1, wherein the prismatic plate, having at least one axially bored patrix fastened thereto, being the elastically flexible and extensible bowl, by which the negative inner shape of article to be formed is reproduced, laid on same patrix, is slidingly fitted, in a crosswise direction, on guide ways formed integrally with, or secured to the table with which the bed plate is fitted.

4. A hydraulic press for shaping and pressing hollow ceramic articles according to claim 1, wherein the stop means by which the cross member, bearing the ejector is firmly retained at the required height, consist of two stub teeth racks, respectively connected with a head, supported by the two vertical, parallel cylindric columns secured to bed plate, and to ejector bearing cross member, being the relative motions of said racks controlled by a hydraulic jack.

* * * * *